United States Patent [19]

Morrell

[11] 4,146,816

[45] Mar. 27, 1979

[54] CATHODE-RAY TUBE WITH A CORRUGATED MASK HAVING A CORRUGATED HINGING SKIRT

[75] Inventor: Albert M. Morrell, Lancaster, Pa.

[73] Assignee: RCA Corporation, New York, N.Y.

[21] Appl. No.: 813,857

[22] Filed: Jul. 8, 1977

[51] Int. Cl.[2] ..... H01J 29/07; H01J 29/02

[52] U.S. Cl. ..... 313/407; 313/403

[58] Field of Search ..... 313/408, 403, 402, 407, 313/404, 405, 406

[56] References Cited

U.S. PATENT DOCUMENTS

| | | | |
|---|---|---|---|
| 2,795,718 | 6/1957 | Van Hekken et al. | 313/408 |
| 3,109,117 | 10/1963 | Kaplan | 313/408 |
| 3,581,135 | 5/1971 | Garrett et al. | 313/404 X |
| 3,585,431 | 6/1971 | Long | 313/407 |
| 3,872,345 | 3/1975 | Yamazaki et al. | 313/402 X |
| 3,944,867 | 3/1976 | Kaplan | 313/403 |

*Primary Examiner*—Robert Segal

*Attorney, Agent, or Firm*—Eugene M. Whitacre; Glenn H. Bruestle; Dennis H. Irlbeck

[57] ABSTRACT

The tube is improved by the shadow mask having an apertured active portion of parallel corrugations and integral corrugated skirt portions extending from the two opposite corrugated edges of the mask and having hinge means therein for interconnecting the mask to the envelope of the tube.

8 Claims, 6 Drawing Figures

CATHODE-RAY TUBE WITH A CORRUGATED MASK HAVING A CORRUGATED HINGING SKIRT

BACKGROUND OF THE INVENTION

This invention relates to shadow mask type cathode ray tubes and, particularly to means for supporting a shadow mask within such tubes.

In a shadow mask tube, a plurality of convergent electron beams are projected through a multiapertured color selection shadow mask to a mosaic screen. The beam paths are such that each beam impinges upon and excites only one kind of color-emitting phosphor on the screen. Generally, the shadow mask is attached to a rigid frame, which in turn, is suspended within the picture tube envelope.

Presently, all commercial color picture tubes have a front or viewing faceplate portion that is either spherical or cylindrical. However, it is desirable to develop a tube having a generally flat faceplate. According to prior art tube design concepts, in tubes having curved faceplates, the shadow mask is similarly curved so that it somewhat parallels the faceplate contour. Thus, in keeping with these prior art concepts, in a tube with a flat faceplate, the corresponding shadow mask should also have an almost flat contour. However, such a mask has insufficient self-supporting strength or rigidity. One way to provide this strength or rigidity would be to put the mask under tension as is done in some commercially available tubes having cylindrical faceplates. However, tension methods require undesirable heavy and expensive frame structures. Another recently suggested way of providing strength to the mask is to give it some degree of contour. But in addition to deviating from prior design concepts, this method raises an additional doming problem. The problem of doming occurs during an initial period of tube operation. It is caused by shadow mask heating and expansion when the mask is bombarded by the electron beams.

SUMMARY OF THE INVENTION

An improved cathode ray tube of the present invention has a shadow mask with an apertured active portion of parallel corrugations and integral corrugated skirt portions extending from the two opposite corrugated edges of the mask and having hinge means therein for interconnecting the mask to the envelope of the tube.

DESCRIPTION OF THE PREFERRED EMBODIMENTS

Figure 1:
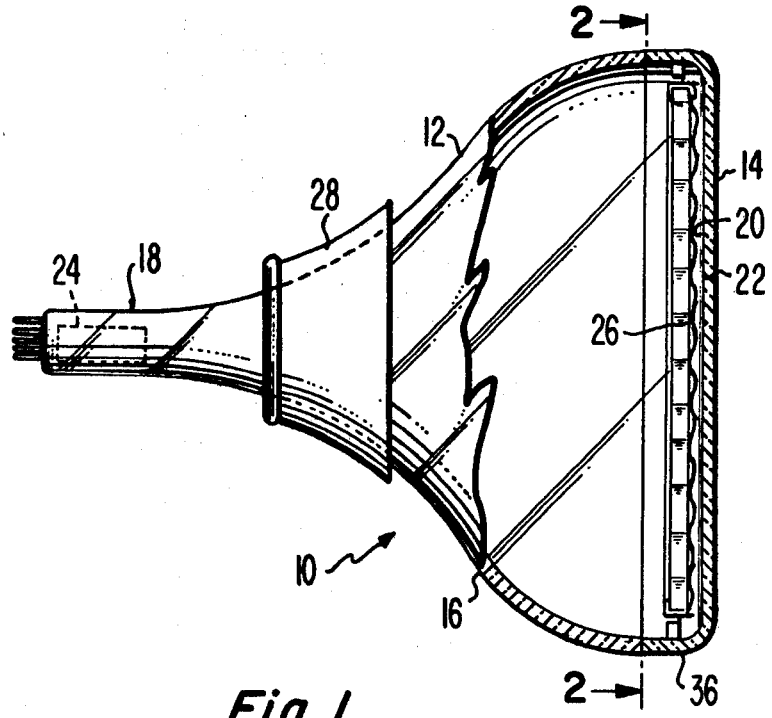
FIG. 1 is a partially cut-away side elevational view of a cathode-ray tube in accordance with the present invention.

A cathode-ray tube 10 including a novel mask is illustrated in FIG. 1. The tube 10 comprises an evacuated envelope 12 including a rectangularly-shaped flat faceplate panel 14, a funnel 16 and a neck 18. A three-color phosphor viewing screen 20 is supported on the inner surface 22 of the faceplate panel 14. Preferably, the screen 20 comprises three interlaced arrays of different color emitting phosphor lines separated by a light absorbing matrix. An electron-gun assembly 24, positioned in the neck 18, includes means for projecting three electron beams, one for each of the three color phosphors of the viewing screen 20. An apertured rectangular shadow mask 26 is positioned in the envelope 12 adjacent to the viewing screen 20. The electron gun assembly 24 is adapted to project electrons from its three electron beams through the apertured mask 26 to strike the viewing-screen structure 20 with the mask 26 serving as a color selection electrode. A magnetic deflection yoke 28 is positioned on the envelope 12 near the intersection of the funnel 16 and the neck 18. When suitably energized, the yoke 28 causes the electron beams to scan the screen 20 in a rectangular raster.

The shadow mask 26 is a formed sheet of metal which is corrugated in the intended direction of high frequency scan of the electron beams. Thus, in conventional television applications, the mask is corrugated along the horizontal axis (in the direction of the larger dimension of the mask) with the corrugations being parallel and extending vertically (between long sides of the mask or in the direction of the shorter dimension of the mask). Although in the mask 26 the corrugated cross-section of the mask is sinusoidal, other corrugated cross-sections are also contemplated to be within the scope of the present invention. The mask is telescoped within a peripheral frame 30 having an L-shaped cross-section frame 30. The frame 30 is suspended within the faceplate panel 14 by means of springs 32 attached to the frame and seated on studs 34 imbedded in the sidewalls 36 of the panel 14. The active portion 37 of the shadow mask 26, that is that portion that provides the shadowing or color selection function, consists of most of the corrugated surface of the mask 26 facing the screen 20. The active portion of the mask has a plurality of elongated apertures aligned in parallel vertical columns (in the direction of the shorter mask dimensional). The column-to-column spacing is varied with respect to the mask-to-screen spacing so that the phosphor elements on the screen are optimally spaced relative to each other.

Figure 2:
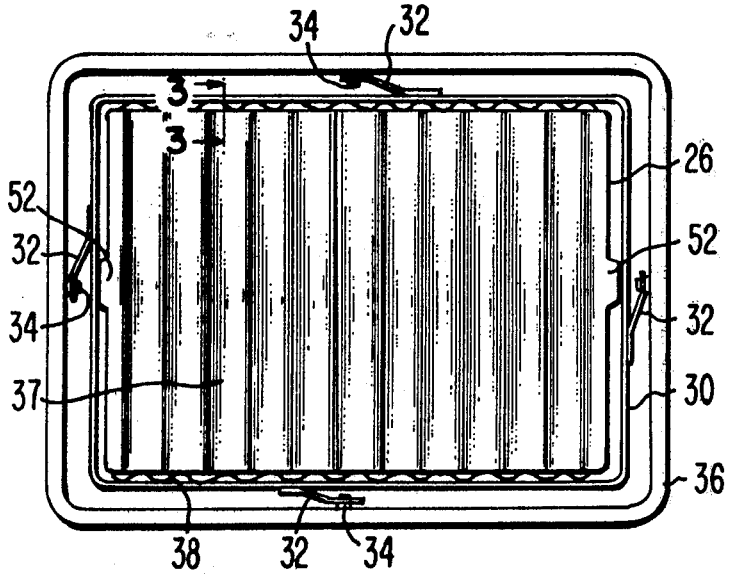
FIG. 2 is a plan view of the tube mask and faceplate taken at line 2—2 of FIG. 1.
Figure 3:
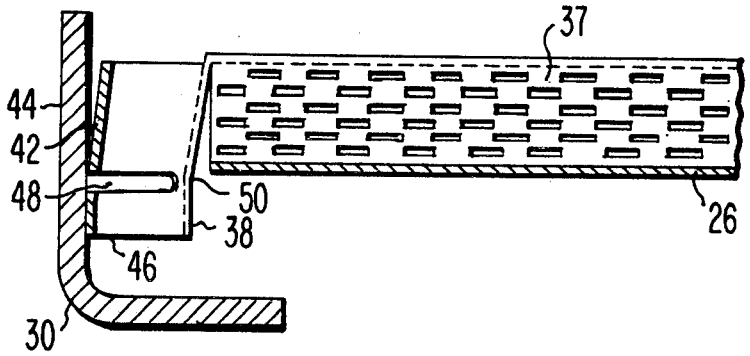
FIG. 3 is an enlarged cross-sectional partial view of the mask and frame taken along line 3—3 of FIG. 2.
Figure 4:
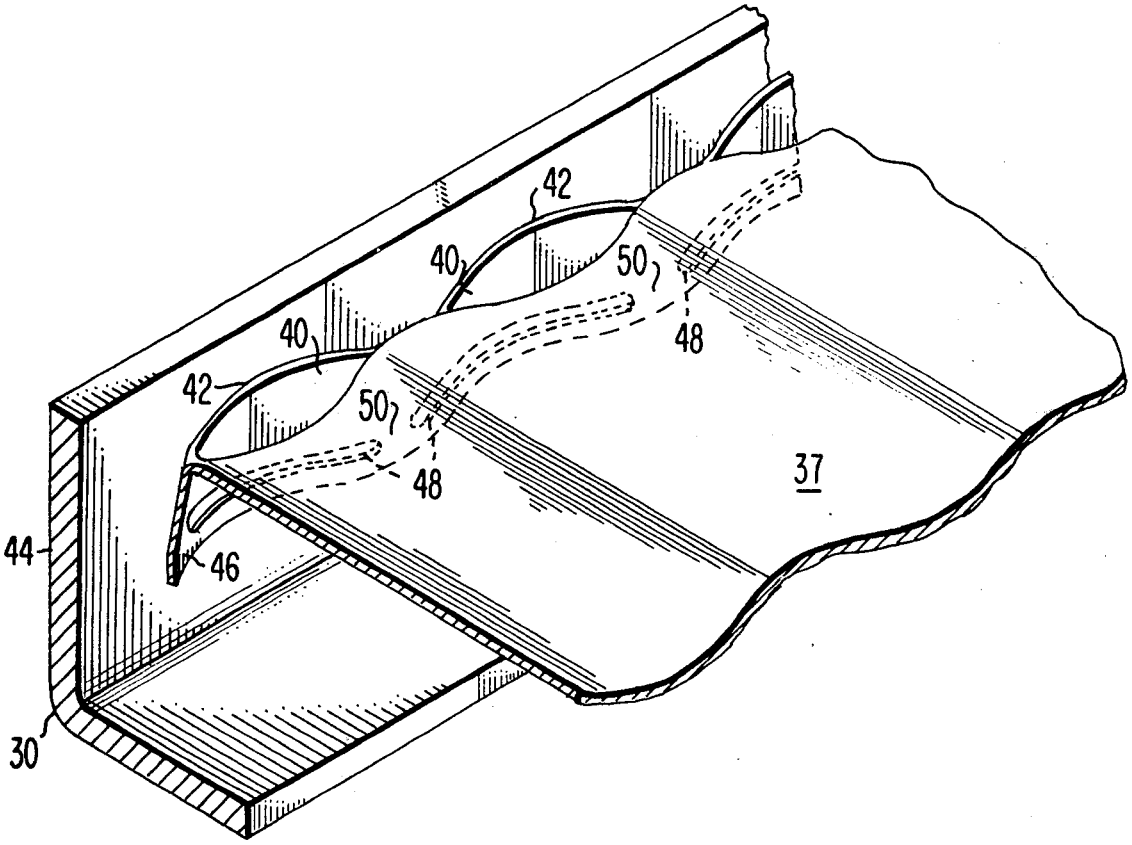
FIG. 4 is an enlarged partial perspective view of the mask and frame of the tube of FIG. 1.

Interconnection between the mask 26 and frame 30 is made by means of a novel skirt arrangement. A skirt 38 comprises integral folded portions along the two corrugated edges of the mask 26, as shown in FIGS. 2, 3 and 4. Preferably, the skirt 38 itself is somewhat corrugated with the same wavelength as the corrugations in the active portion of the mask, but 180 degrees out-of-phase with the active portion corrugations before it is folded. As shown in FIG. 4, the inner corrugation peaks of the skirt 38 are attached at points to the corrugated peaks of the active portion 37 of the mask 26. In between these attachment points, the mask is divided with a plurality of slits 40 which permit the skirt corrugations to be formed. The portion 42 of the skirt 38 adjacent to the active portion 37 of the mask is angled slightly with respect to an outer flange 44 of the frame 30 so that only a distal portion 46 of the skirt makes substantial contact with the frame 30. The distal portion 46 of the skirt 38 is partially separated from the portion 42 adjacent to the active portion 26 by longitudinal slots 48 that extend almost to the corrugated peaks of the skirt 48 that are connected to the active portion 37 of the mask 26.

The purpose of the slots 48 is to weaken any spring effect the skirt may have on the remainder of the mask when the mask thermally expands during tube operation. Ideally, a spring free pivot is desired at the two skirted sides of the mask. In the present embodiment, the pivot or hinge is essentially that portion 50 of the skirt located between the slots 48. Therefore, as the mask 26 is heated during tube operation, the mask expands thus forcing the adjacent portion 42 of the skirt 38 toward the frame flange 44. As the portion 42 so moves, it is permitted to pivot slightly relative to the distal portion 46 of the skirt 38 by the hinge portion 50.

Vertical position of the mask 26 with respect to the frame 30 during tube operation is held by means of two centered extensions 52 on the straight sides of the mask 26 which are attached to corresponding central side portions of the frame 30, as shown in FIG. 2.

Fabrication of the shadow mask 26 begins with coating a metal sheet on both sides with a suitable photoresist and exposing the two sides of the sheet through two photomasters having the desired aperture patterns. Included in the photomaster patterns are appropriate patterns for exposing the slits 40 which define the separation between the active portion 37 of the mask and the skirt 38 permit formation of the corrugations. Following exposure, the metal sheet is etched with a suitable etchant until all of the openings in the mask are formed. Thereafter, the corrugations in both the active portion 38 and the skirt 38 are formed by pressing the sheet on a properly contoured die. Next, the skirt 38 is folded along the line of the slits 40 to the desired angle with respect to the active portion 37.

Figure 5:
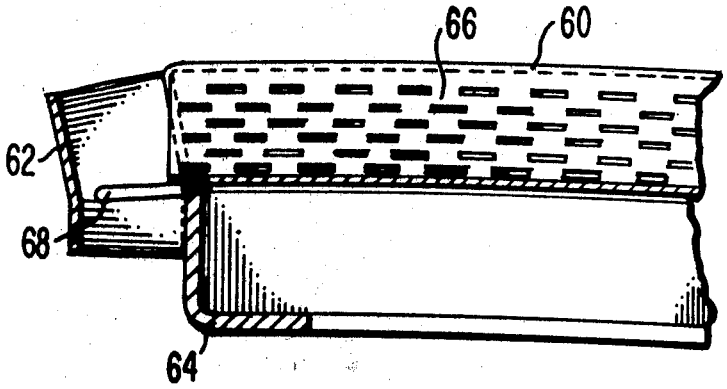
FIG. 5 is a cross-section partial view of another mask-frame assembly in accordance with the present invention.
Figure 6:
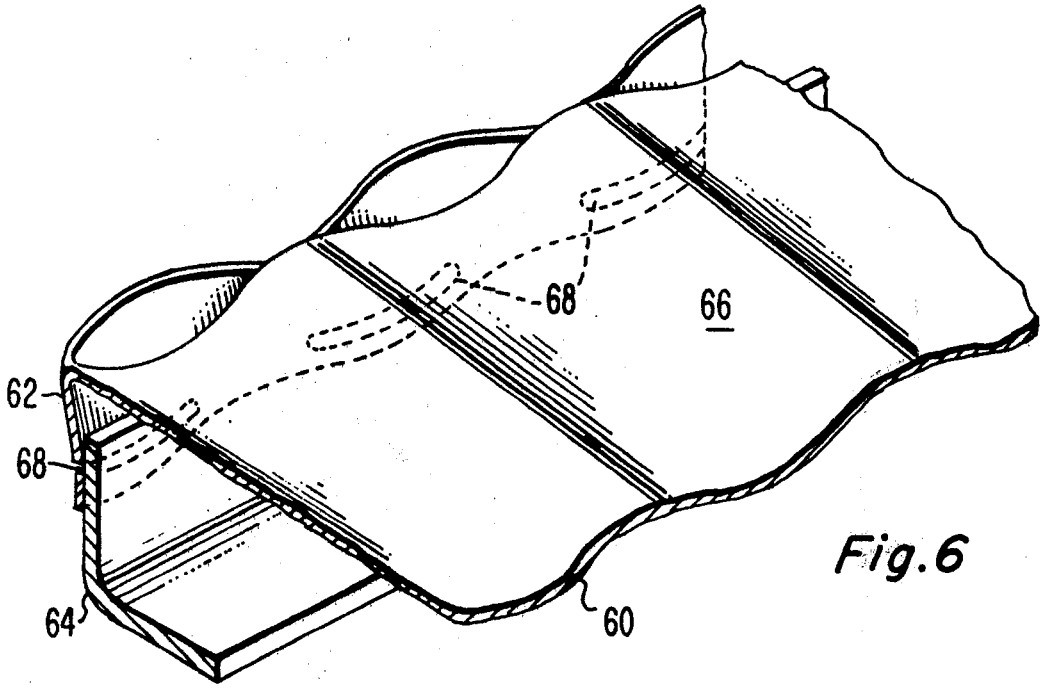
FIG. 6 is a partial perspective view of the mask-frame assembly of FIG. 5.

Another embodiment of the present invention is shown in FIGS. 5 and 6. In this embodiment, a mask 60 has a skirt 62 telescoped over an L-shaped frame 64. The construction of an active portion 66 of the mask 60 is identical to the active portion 37 of the mask 26, comprising an apertured corrugated sheet. The skirt 62 is also similar to the skirt 38 of the mask 26 except that it is bent slightly inwardly and has longitudinal slots 68 shifted one half wavelength along the skirt waveform from the location of the slots 48 in the mask 26.

In the foregoing embodiments, the wavelengths of the corrugated skirts were the same as the wavelengths of the corrugations of the active portion of the mask. Alternatively, the corrugated wavelength of the skirt can be two, three, etc. times longer than the corrugated wavelength of the active portion of the mask. In such embodiments, the skirt would connect to the active portion at every two, three, etc. cycles of the active portion waveform. Similarly, a more rigid support can be achieved by corrugating the skirt with a shorter wavelength than the active portion wavelength.

Of principal concern in any embodiment having a vertical line screen and a slit mask is the prevention or at least minimization of the effective horizontal motion of the mask. Such motion can be caused by thermal expansion of a mask in the horizontal direction or by movement of a mask along the longitudinal axis of the tube whereby relative to the electron beam paths there is an effective horizontal component to the movement. Motion of the mask in the vertical direction is of little consequence since the mask slits and screen lines will still remain aligned. In all of the foregoing embodiments, the hinges provided by the skirts permit vertical expansion of the active portions of the masks yet hold the mask from movement along the longitudinal axis of a tube and from horizontal movement. Horizontal thermal expansion of a mask is taken up by the deepening (increase of wave amplitude) of the corrugations in the active portions which results in only a negligible change in slit-line screen registration.

Although the foregoing embodiments are described with respect to a shadow mask type tube wherein a mask and screen are held at the same electrical potential, it should be understood that the present invention is also applicable to other varieties of shadow mask tubes such as to a tube where the mask and screen are held at different potentials. Such tubes are also known as focus mask or focus shadow mask tubes.

I claim:

1. In a shadow mask type cathode-ray tube having a shadow mask support frame suspended therein, the improvement comprising, a shadow mask having a corrugated apertured active portion of parallel corrugations, said mask having integral corrugated skirt portions extending from the two opposite corrugated edges, each skirt portion having a distal end portion attached to said frame and each skirt portion having a plurality of spaced aligned elongated slots between the points of attachment to the active portion and the distal end portion of the skirt portions, said slots having their longitudinal dimension perpendicular to the central axis of said tube, whereby expansion of said mask causes the skirt portions to pivot at a part of the skirt portions between the spaced aligned elongated slots.

2. The tube as defined in claim 1 wherein said skirt portions are telescoped within said frame.

3. The tube as defined in claim 1 wherein said skirt portions are telescoped over said frame.

4. The tube as defined in claim 1 wherein the skirt portions are corrugated at the same wavelength as adjacent corrugations of the active portion of the mask.

5. The tube as defined in claim 4 wherein the corrugations of the skirt portions are 180 degrees out-of-phase with the corrugations of the active portion.

6. The tube as defined in claim 1 wherein a viewing faceplate of said tube is substantially flat.

7. In a shadow mask type cathode-ray tube having an envelope, the improvement comprising, a shadow mask having a corrugated apertured active portion of slit-shaped apertures aligned in columns wherein the peak-to-peak wavelength dimension of corrugations in the mask is at least twice as great as the spacing between aperture columns, and an integral bent-over corrugated skirt attached to the active portion only at peak regions of the corrugations of the active portion, the intersection of said skirt and active portion having slits between the peak regions of attachment, said skirt interconnecting the active portion to the envelope, wherein said skirt includes a plurality of spaced aligned elongated slots located between the slits and a portion of the skirt interconnected to the envelope, whereby portions of the skirt between the slots form hinges to accomodate expansion of the apertured active portion.

8. In a shadow mask type cathode ray tube having an envelope, the improvement comprising, a shadow mask having a corrugated apertured active portion of slit-shaped apertures aligned in columns wherein the peak-to-peak wavelength dimension of corrugations in the mask is at least twice as great as the spacing between aperture columns, and an integral bent-over corrugated skirt attached to the active portion, the corrugations of said skirt being out-of-phase with the corrugations of said apertured active portion, said skirt interconnecting the active portion to the envelope, wherein said skirt includes a plurality of spaced aligned elongated slots located between the ends of the skirt that are attached to the apertured active portion and the distal end of the skirt that is interconnected to the envelope, whereby portions of the skirt between the slots form hinges to accomodate expansion of the apertured active portion.

* * * * *